US009350060B2

(12) United States Patent
Subedi et al.

(10) Patent No.: US 9,350,060 B2
(45) Date of Patent: May 24, 2016

(54) COMBLINE-CAVITY DUPLEXER, DUPLEXING APPARATUS, AND ANTENNA SYSTEM FOR FREQUENCY DIVISION DUPLEXING OPERATION

(75) Inventors: Purna C. Subedi, Irvine, CA (US); Khurram Parviz Sheikh, San Clemente, CA (US)

(73) Assignee: Intel Corporation, Santa Clara, CA (US)

( * ) Notice: Subject to any disclaimer, the term of this patent is extended or adjusted under 35 U.S.C. 154(b) by 383 days.

(21) Appl. No.: 13/602,931

(22) Filed: Sep. 4, 2012

(65) Prior Publication Data

US 2013/0088306 A1 Apr. 11, 2013

Related U.S. Application Data

(60) Provisional application No. 61/531,306, filed on Sep. 6, 2011.

(51) Int. Cl.

| | |
|---|---|
| ***H01P 1/213*** | (2006.01) |
| ***H01P 1/202*** | (2006.01) |
| ***H01P 7/04*** | (2006.01) |
| ***H01P 1/20*** | (2006.01) |

(52) U.S. Cl.

CPC ..... *H01P 1/20* (2013.01); *H01P 1/2136* (2013.01); *H01P 1/202* (2013.01); *H01P 7/04* (2013.01)

(58) Field of Classification Search

CPC ..... H01P 1/208; H01P 1/2133; H01P 1/2136; H01P 7/04; H01P 1/2053; H01P 1/202

USPC ..... 333/208, 123, 126, 129, 132, 206, 207,333/222–225, 202

See application file for complete search history.

(56) References Cited

U.S. PATENT DOCUMENTS

| | | | | |
|---|---|---|---|---|
| 5,151,670 | A * | 9/1992 | Blair | H01P 1/2136 333/124 |
| 5,905,416 | A * | 5/1999 | Schmid et al. | 333/134 |
| 6,366,184 | B1 * | 4/2002 | Ohtonen | 333/202 |
| 6,392,506 | B2 * | 5/2002 | Wulff | 333/134 |
| 6,429,756 | B1 * | 8/2002 | Kurisu | H01P 7/10 333/134 |
| 6,518,858 | B2 * | 2/2003 | Ando et al. | 333/134 |
| 6,781,476 | B2 * | 8/2004 | Tsunoda et al. | 333/110 |
| 7,777,593 | B2 * | 8/2010 | Weitzenberger | 333/134 |

(Continued)

FOREIGN PATENT DOCUMENTS

| | | | |
|---|---|---|---|
| CN | 2694508 | Y | 4/2005 |
| CN | 10417016 | A | 11/2014 |
| WO | WO2013/036485 | A1 | 3/2013 |

OTHER PUBLICATIONS

"European Application Serial No. 12770331.2, Office Action mailed May 6, 2014", 2 pgs.

"European Application Serial No. 12770331.2, Response filed Nov. 17, 2014 to Office Action mailed May 6, 2014", 16 pgs.

"International Application Serial No. PCT/US2012/053676, International Preliminary Report on Patentability mailed Mar. 20, 2014", 8 pgs.

(Continued)

*Primary Examiner* — Robert Pascal
*Assistant Examiner* — Gerald Stevens
(74) *Attorney, Agent, or Firm* — Schwegman Lundberg & Woessner, P.A.

(57) ABSTRACT

The present disclosure relates to microwave cavity filters used in cellular communication systems. More specifically, in one aspect, the present disclosure relates to the integration of combline cavity filters directly with antenna elements without galvanic connections. In another aspect, the present disclosure relates methods for loading combline filters without contact.

24 Claims, 8 Drawing Sheets

(56) References Cited

U.S. PATENT DOCUMENTS

| | | | | |
|---|---|---|---|---|
| 2001/0030587 | A1 | 10/2001 | Wulff | |
| 2002/0145490 | A1 | 10/2002 | Sauder | |
| 2004/0222868 | A1 | 11/2004 | Rathgeber | |
| 2009/0153264 | A1* | 6/2009 | Tanpo et al. | 333/103 |
| 2011/0241801 | A1* | 10/2011 | Subedi | H01P 1/2053 333/203 |

OTHER PUBLICATIONS

"International Application Serial No. PCT/US2012/053676, International Search Report mailed Dec. 3, 2012", 4 pgs.
"International Application Serial No. PCT/US20121053676, Written Opinion mailed Dec. 3, 2012", 6 pgs.

* cited by examiner

COMBLINE-CAVITY DUPLEXER, DUPLEXING APPARATUS, AND ANTENNA SYSTEM FOR FREQUENCY DIVISION DUPLEXING OPERATION

CROSS-REFERENCE TO RELATED APPLICATION

This application claims the benefit of U.S. Provisional Patent Application No. 61/531,306, entitled OPEN CIRCUIT COMMON JUNCTION FEED FOR DUPLEXER and filed on Sep. 6, 2011, the entirety of which is incorporated herein by reference.

BACKGROUND

Complete base station functionality may be housed inside a radome enclosure. Therefore, interconnecting different modules within the enclosure in the most efficient way for performance, size and ease of assembly becomes very critical. Recently, there has been increased integration of all of the transmitting and receiving components, such as the duplexers/filters, the antenna patches, the power amplifiers, the low noise amplifiers, the phase shifters, digital signal processing and other control electronics inside the radome enclosure itself. Such integrated antenna radio systems are known as active antenna arrays (AAA). One advantage of AAAs is that traditionally bulky radio systems can be shrunk to almost the size of the antenna itself, thereby eliminating external RF connectors and RF coaxial cables. Only data and power lines may be input to AAAs, resulting in significant performance enhancement with reduced power consumption.

In an integrated architecture, the improvements in the link budget are seen to be around 3 dB to 5 dB. Such link budget improvements imply that the traditional base station's coverage radius is increased by close to 100%, and the total power consumption is reduced by as much as 40%, thereby creating a higher performing system for lower cost. Since antenna systems are typically placed in elevated locations, weight is preferred to be as light as possible, with the goal being for one person lift. Therefore, any integration that can be done without requiring additional parts has not only mechanical advantages in terms of weight and ease of assembly, but also significant performance advantages. Traditional methods of coupling and feeding require an internal galvanic connection. Such a galvanic connection may be subject to difficulties in assembly, may introduce losses, and may also be prone to intermodulation in case of intermittent connections.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figures 1A, 1B, 1C, 1D:
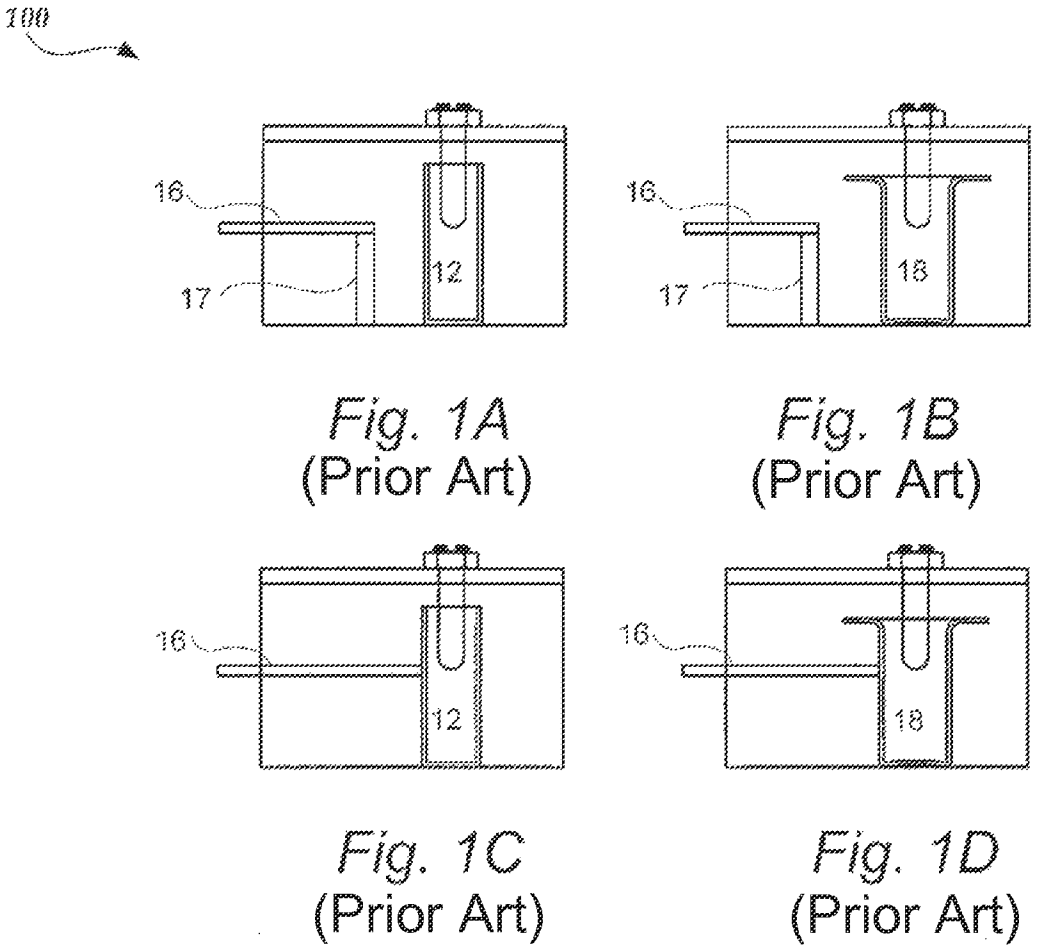
Fig. 1A (Prior Art)
Fig. 1B (Prior Art)
Fig. 1C (Prior Art)
Fig. 1D (Prior Art)
FIGS. 1A-1D illustrate input/output coupling techniques used in the prior art.

The present disclosure relates to microwave cavity filters used in cellular communication systems. More specifically, in one aspect, the present disclosure relates to the integration of combline cavity filters directly with antenna elements without galvanic connections. In another aspect, the present disclosure relates methods for loading combline filters without contact. One skilled in the relevant art will appreciate, however, the additional or alternative aspects may be evident in accordance with the present disclosure.

Embodiments of this invention provide many advantages, including eliminating connectors and long transmission lines to connect to the antenna elements and thus making the whole antenna lighter in weight and reducing path loss. By way of an illustrative example, in a traditional six element array, there would be 24 connectors (12 on the duplexer side and 12 on the antenna side) and 12 transmission cables required to make connections between antenna patches and the diplexers. As previously described, each of these connections would increase the cost and complexity of manufacture and could be the source, at least in part, to losses experienced by the operating of the array. In accordance with the present disclosure, a six element array implementing the disclosed coupling technique would mitigate the losses associated with the traditional connections. Additionally, the six element array would likely be easier to assemble and would experience an additional potential reduction of passive intermodulation production from the duplexing junction since there is no galvanic connection in embodiments of this invention.

Embodiments of the invention will be described in reference with the accompanying figures. It shall be understood that the following description, together with numerous specific details, may not contain certain details that may have been omitted as it shall be understood that numerous variations are possible and thus will be detracting from the full understanding of the present invention. It will be apparent, however, to those skilled in the art, that the present invention may be put into practice while utilizing various techniques.

FIGS. 1A-1D illustrate input/output coupling techniques used in traditional junction. components. As illustrated in FIGS. 1A-1D, input and output coupling is done by either directly connecting the center transmission line 16 into the resonator 12 (FIG. 1A) (or a common resonator 18, FIG. 1B), or by connecting to a loading post 17 which is parallel to the resonator 12 (FIG. 1C) (or to the common resonator 18, FIG. 1D) and is grounded at the opposite end.

Figure 2A:
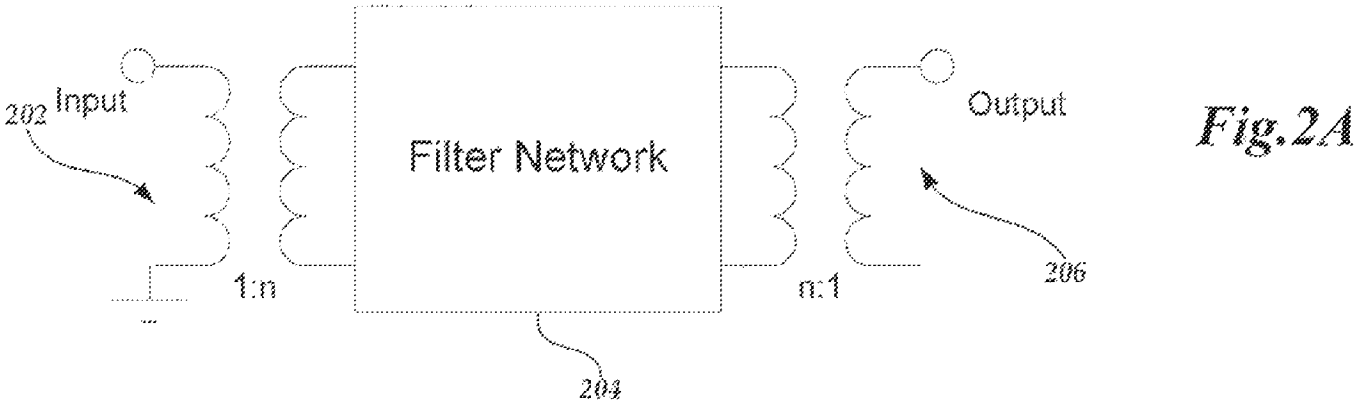
FIGS. 2A-2C illustrate basic combline filter theory.
Figure 2B:
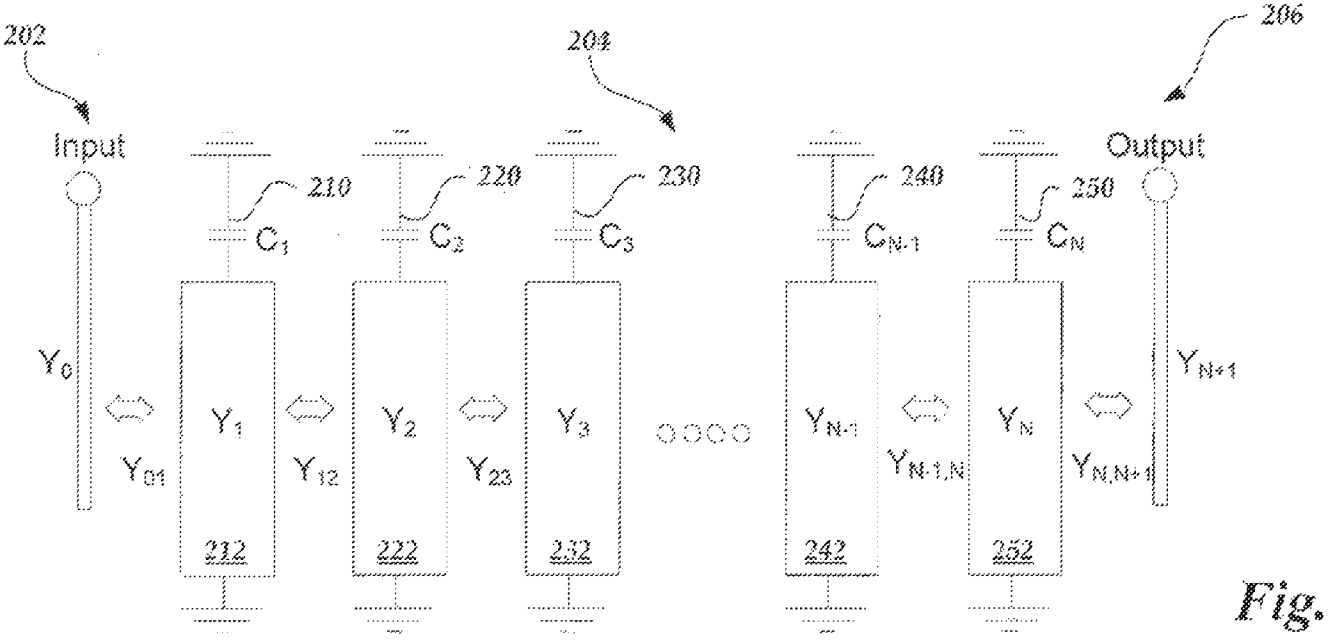
Figure 2C:
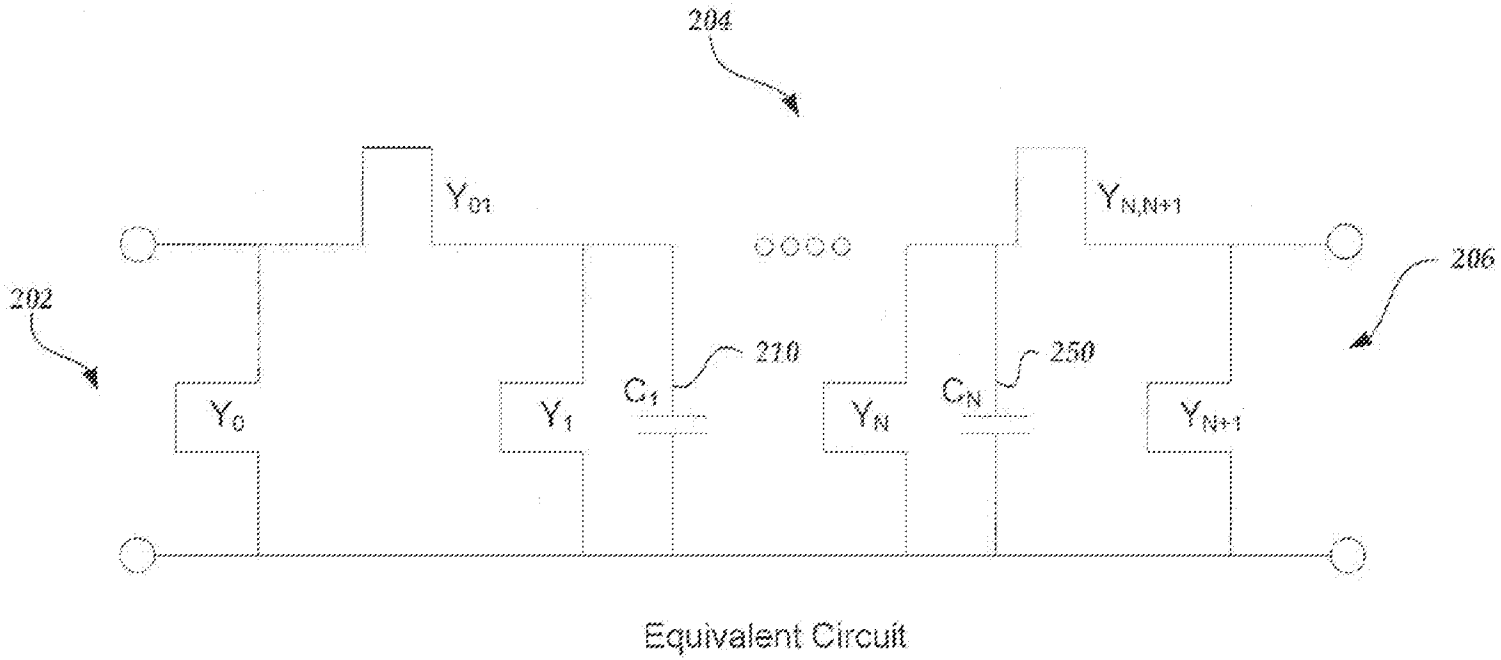

For ease of understanding, basics of the theory of resonator operation are briefly described below in reference with FIGS. 2A-2C. FIG. 2A illustrates an input 202 to a filter network 204, which in turn is connected to an output 206. As illustrated in FIG. 2B, the filter network 204 can include combline filters 212, 222, 232, 242 and 252 which are inductively coupled resonators with an electrical length less than about 90° degree, which are grounded at one end with capacitive tuning screws giving capacitances C1 (210), C2 (220), C3 (230), C4 (240) . . . CN (250) (for resonators 1, 2 . . . N respectively), for fine adjustment at the other end. The desired performance helps to determine the number of these resonators used in a particular fitter. These resonators may be cross coupled either inductively or coactively for an asymmetric filter response. For example, it is possible to have more selective resonators on one side of the pass band than the other side of the pass band. Such an asymmetric response may be more typical in real world applications. An equivalent circuit of the filter network 204 is illustrated in FIG. 2C.

One skilled in the relevant art will appreciate that voltages $V_N$ at the end of each resonator are related to the currents $I_N$ in accordance with the following matrix, sometimes referred to as the admittance matrix:

$$\begin{bmatrix} I_1 \\ I_2 \\ \vdots \\ \vdots \\ I_{N-1} \\ I_N \end{bmatrix} = \frac{1}{\tanh\left(\frac{l}{v}\right)} \begin{bmatrix} Y_{11} & -Y_{12} & 0 & 0 & \cdots & & \\ -Y_{12} & Y_{22} & -Y_{23} & 0 & & & \\ 0 & -Y_{23} & Y_{33} & -Y_{34} & & & \\ \vdots & & -Y_{34} & \ddots & & & \\ & & & & & Y_{N-1,N-1} & -Y_{N-1,N} \\ & & & & & -Y_{N-1,N} & Y_{NN} \end{bmatrix} \begin{bmatrix} V_1 \\ V_2 \\ \vdots \\ \vdots \\ V_{N-1} \\ V_N \end{bmatrix} \quad (1)$$

where $Y_{ij}$ = the admittance matrix and with $i = 1$ to $N$ and $j = 1$ to $N$.

$l$ = length of resonators.

$v$ = progagation velocity.

With one common port, two filters separated in bands of frequencies are called a duplexer or a diplexer; three filters separated by bands of frequencies are called a triplexer, four filters separated by bands of frequencies are called a quadplexer, and so on. More generally, a plurality of filters sharing a common port is called a multiplexer. An example of a duplexer 300 is shown FIG. 3. Each filter, 310 and 320, has an input port 312 and 322, and an output port 314 and 324 respectively. The duplexer 300 includes a duplexing junction 320, which is coupled to an antenna component 340 or antenna feed.

Illustratively, the display junction 320 can implement traditional methods of coupling illustrated in FIG. 1 require an internal galvanic connection. Such a galvanic connection may be subject to difficulties in assembly, and may also be prone to intermodulation in case of intermittent connections. Alternatively, the display junction component of the present disclosure may be implemented.

Figure 3:
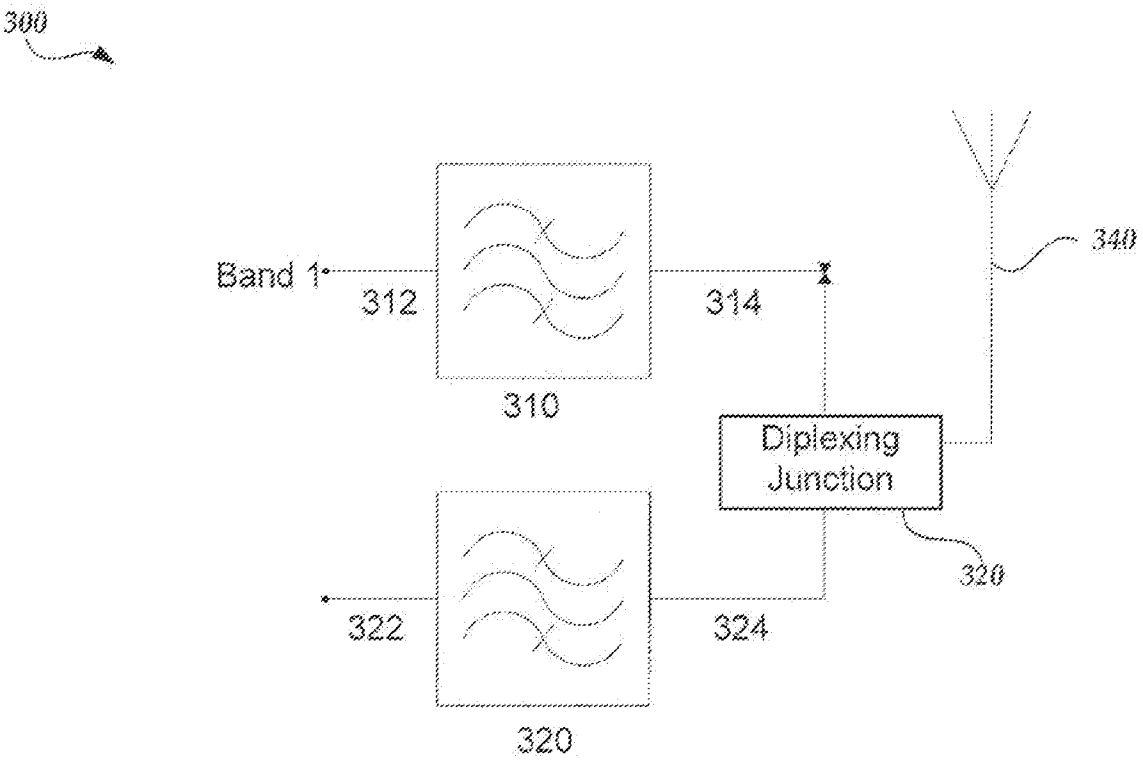
FIG. 3 illustrates a duplexer including a duplexing junction and the antenna.
Figure 4A:
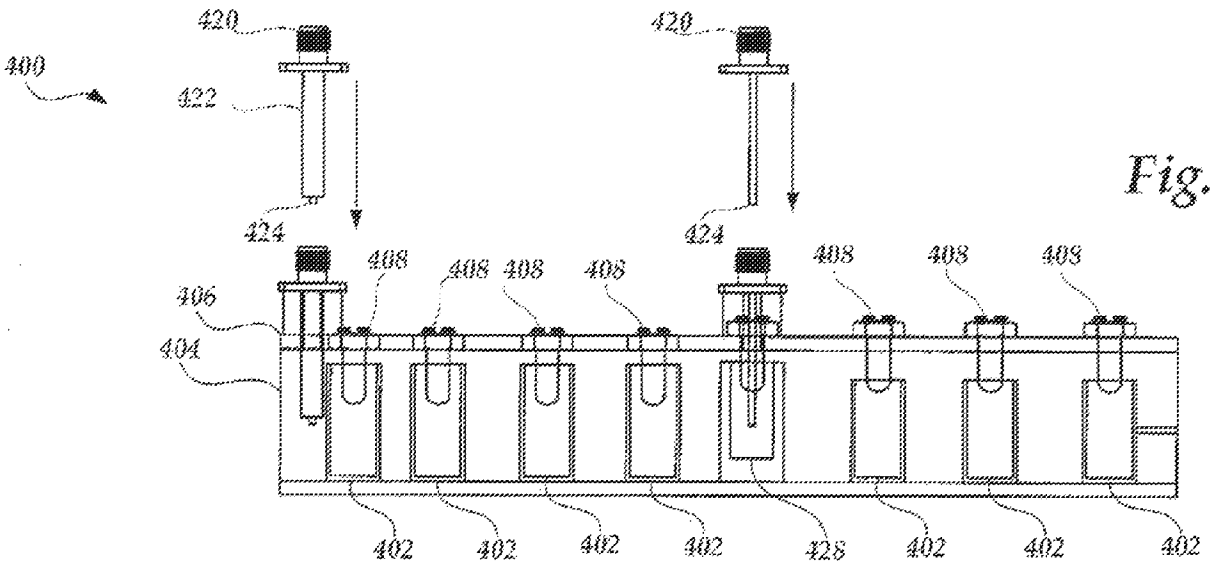
FIGS. 4A-4C depict embodiments of the duplexing junction.
Figure 4B:
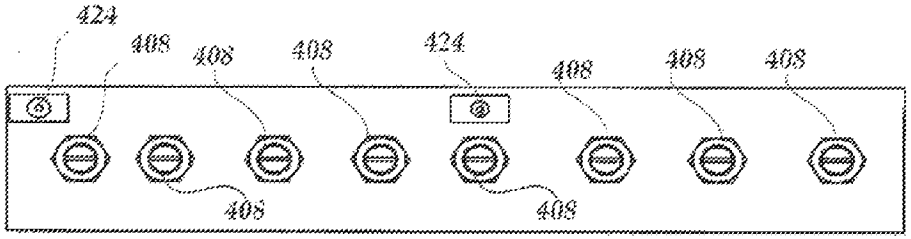

FIGS. 4A-4C and 5A-5D illustrative various embodiments for implementing the display junction 320 (FIG. 3). As illustrated in FIGS. 4A and 4B, a main filter housing 404, which may be made of metal, and may also include a main lid 406, also made of metal, may house a plurality of resonators 402. The housing 404 may also include a common resonator 428, common to both transmit and receive filters. The resonators 402 and the common resonator 428 may be locked down inside the main housing 13 through a tuning screw and nut assembly 408. The assembly 408 may be moved up and down to be locked down.

The amount of required coupling of RF energy into the filter is dependent on the proximity to the resonator 402, 428 and also to the penetration of a probe 426 into the housing 404. In some embodiments, a probe 424 may be used to perform the coupling. Generally, the longer the probe 424 is, the stronger the coupling is. The depth of the probe 424 penetration may be practically limited by the dimensions of the housing 404. The probe 424 may be designed to be about a few millimeters away from the floor of the housing 404. In various embodiments, this probe 424 may be either bare metal or it can be covered with a dielectric material as known in the art. Traditionally, the inputs and outputs of the filter would be connected to the resonator 402 or 428 through direct soldering, screwing or pressing. Embodiments disclosed herein enable tuning of the filter without a direct metal to metal contact, but rather through coupling with a probe 424 without a galvanic contact.

With continued reference to FIG. 4A, the filter 400 may be tuned with connectors 420 having center pins 426 connected to the connectors 420. In some embodiments, the connector 426 may be an open circuited bare wire, such as the connector shown in the middle top of FIG. 4A. In other embodiments, the bare wire may be covered with insulation 422, which may be made of suitable insulating materials. The insulation 422 ensures that the common junction does not touch the resonators 402. Additionally, the insulation 422 may help increase coupling compared to just air dielectric which can also be used for additional tuning flexibility.

Figure 4C:
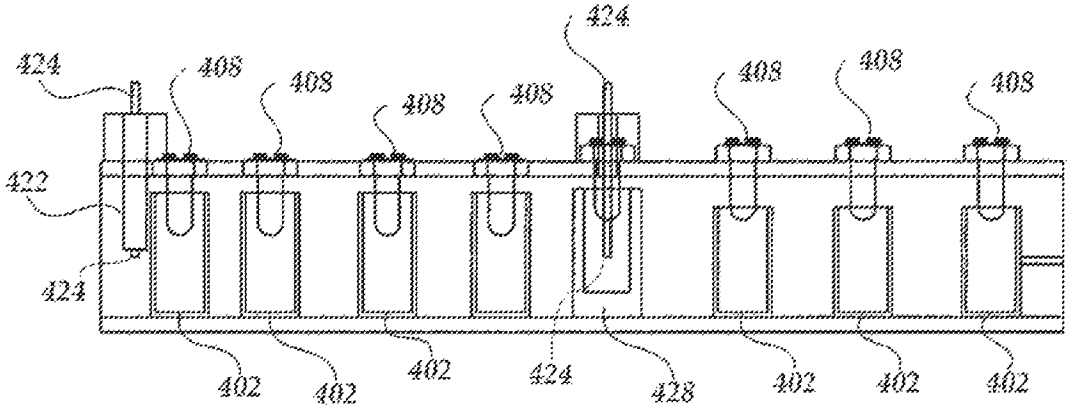
Figure 5A:
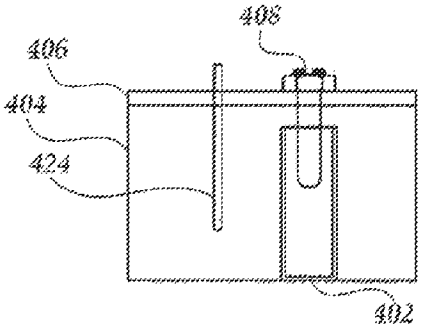
FIGS. 5A-D depict embodiments of the duplexing junction.
Figure 5B:
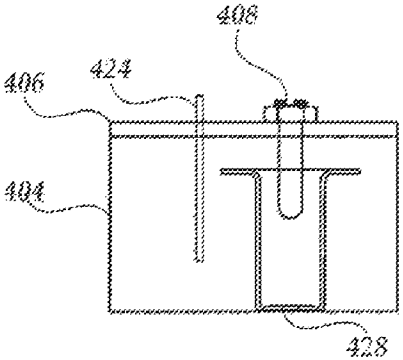
Figure 5C:
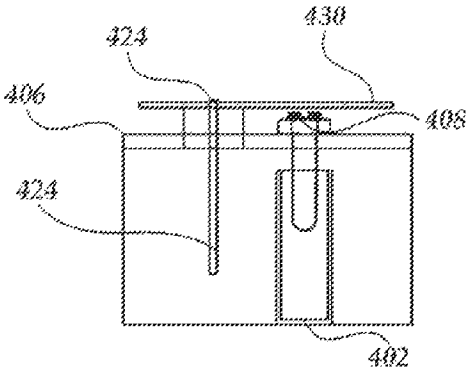
Figure 5D:
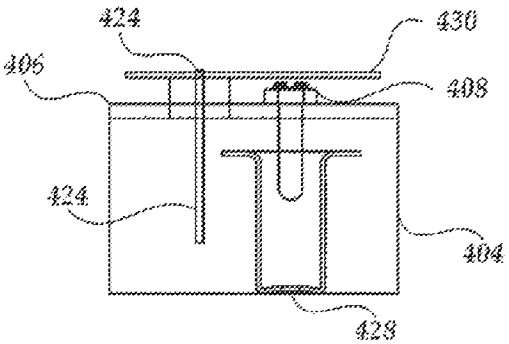

When the filter is tuned satisfactorily, the connector 420 with the center pin 424 can be removed and a new center pin with the same dimensions (including diameter) can be inserted, which will provide greater flexibility to connect other modules to the filter. As illustrated in FIG. 4C, in other embodiments, only the connector 420 may be removed, keeping the center pin 424 in place. In some applications, the center pin 424 can be just the center pin of the connector, i.e. a connector having a long center pin 424 may be used as the open circuited probe. In other embodiments, the center pin 424 may be covered with insulation 422.

FIG. 5A-5D illustrate embodiments where the probes protrude from the cover 406 of the housing 404. FIGS. 5A-5D show only the first Ix and the first Rx resonator 402, or only the common resonator 428 of the filter for ease of illustration. A metal probe 424 coming down parallel to the resonators 402 (FIGS. 5A and 5C) or the common resonator 428 (FIGS. 5B and 5D) is capable of coupling the RF energy in to the filter. In some embodiments, such as those shown in FIGS. 5C and 5D, a circuit board 430 may be placed with the probe 424 sticking through it, and the probe may be soldered to the trace on the circuit board 430. As illustrated in FIGS. 5A-5D, the probe 424 eliminates the need for a galvanic connection at the antenna junction. As previously discussed, the use of the probe connection to the resonator allows the antenna feed element to be directly connected without additional cables and connectors.

Figure 6:
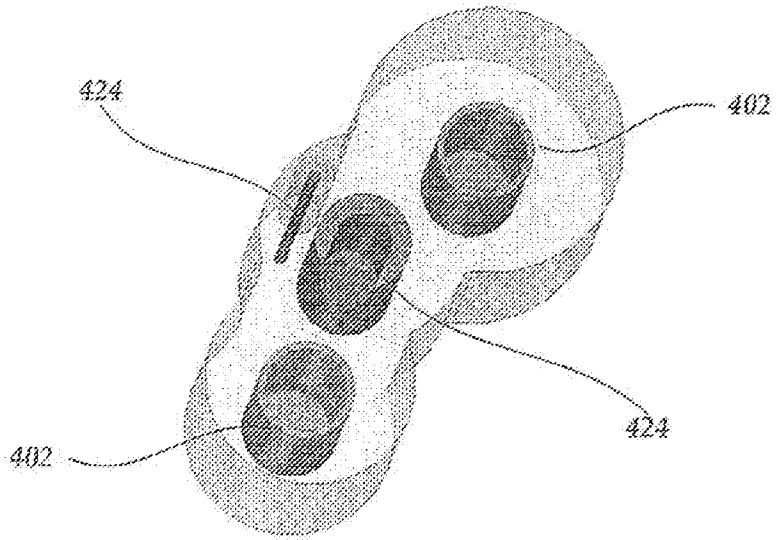
FIG. 6 illustrates a top view of an embodiment of the duplexing junction.

FIG. 6 illustrates a top view of an embodiment of the duplexing junction. FIG. 6 illustrates a common resonator 428 coupled using an open ended probe 424. For ease of understanding, only the first Tx and the first Rx resonator 402 of the antenna are shown, but several resonators may be present in the housing.

Embodiments disclosed herein enable direct integration of the duplexer common junction with an open ended probe loading with the antenna feed in an antenna array system. Combline cavity duplexers used in a picocell, a femto cell and active antenna array communication systems may use the open circuited coupling disclosed. Microwave combline filters can also use the disclosed open circuited probe couplings. Also disclosed are methods of interfacing microwave combline filters having open circuited probe couplings with any external device. A long center connector pin may be used as the open circuited coupling probe.

While illustrative embodiments have been disclosed and discussed, one skilled in the relevant art will appreciate that additional or alternative embodiments may be implemented within the spirit and scope of the present disclosure. Additionally, although many embodiments have been indicated as illustrative, one skilled in the relevant art will appreciate that the illustrative embodiments do not need to be combined or implemented together. As such, some illustrative embodiments do not need to be utilized or implemented in accordance with the scope of variations to the present disclosure.

Conditional language, such as, among others, "can," "could," "might," or "may," unless specifically stated otherwise, or otherwise understood within the context as used, is generally intended to convey that certain embodiments include, while other embodiments do not include, certain features, elements or steps. Thus, such conditional language is not generally intended to imply that features, elements or steps are in any way required for one or more embodiments or that one or more embodiments necessarily include logic for deciding, with or without user input or prompting, whether these features, elements or steps are included or are to be performed in any particular embodiment. Moreover, unless specifically stated otherwise, or otherwise understood within the context as used, is generally intended to convey utilization of the conjunction "or" in enumerating a list of elements does not limit the selection of only a single element and can include the combination of two or more elements.

Any process descriptions, elements, or blocks in the flow diagrams described herein and/or depicted in the attached figures should be understood as potentially representing modules, segments, or portions of code which include one or more executable instructions for implementing specific logical functions or steps in the process. Alternate implementations are included within the scope of the embodiments described herein in which elements or functions may be deleted, executed out of order from that shown or discussed, including substantially concurrently or in reverse order, depending on the functionality involved, as would be understood by those skilled in the art. It will further be appreciated that the data and/or components described above may be stored on a computer-readable medium and loaded into memory of the computing device using a drive mechanism associated with a computer-readable medium storing the computer executable components, such as a CD-ROM, DVD-ROM, or network interface. Further, the component and/or data can be included in a single device or distributed in any manner. Accordingly, general purpose computing devices may be configured to implement the processes, algorithms and methodology of the present disclosure with the processing and/or execution of the various data and/or components described above. Alternatively, some or all of the methods described herein may alternatively be embodied in specialized computer hardware. In addition, the components referred to herein may be implemented in hardware, software, firmware or a combination thereof.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. A combline-cavity duplexer comprising:

a housing encompassing:

a plurality of individual resonators including a set of transmit (TX) resonators and a set of receiver (RX) resonators, each of the plurality of individual resonators having a defined capacitance and individually grounded;

one or more common resonators, the one or more common resonators being common to the set of transmit resonators and the set of receive resonators;

wherein the plurality of individual resonators and the one or more common resonators are all provided within a single common cavity of the housing to forma combline cavity filter configured to operate as a filter network, wherein the filter network comprises a transmit filter and a receive filter to provide separate frequency bands for concurrent transmission and reception for frequency division duplexing operation, wherein the transmit filter comprises the set of transmit resonators and the one or more common resonators, wherein the receive filter comprises the set of receive resonators and the one or more common resonators; and a set of open-circuited probes, the probes to couple signals within the common cavity from the plurality of individual resonators and the one or more common resonators to one or more external components through open-circuit probe coupling independent of a galvanic contact with the plurality of individual resonators or the one or more common resonators.

2. The combline-cavity duplexer as recited in claim 1 further comprising a screw and nut assembly for tuning the plurality of individual resonators and the one or more common resonators by controlling a depth associated with the screw.

3. The combline-cavity duplexer as recited in claim 1 further comprising a lid.

4. The combline-cavity duplexer as recited in claim 3, wherein at least one probe of the set of probes includes a connector mounted on the lid.

5. The combline-cavity duplexer as recited in claim 3, wherein at least one of the probes extrudes through the lid, wherein the at least one probe is are open ended and comprises a center conductor in parallel with the individual resonators, the center conductor extending into the common cavity without having galvanic contact with the lid or the housing, and wherein the individual resonators are cylindrically shaped having an open end exposed to the common cavity without contacting the housing.

6. The combline-cavity duplexer as recited in claim 5 further comprising a circuit board mounted above the lid, wherein the circuit board includes an opening for the at least one probe extruding through the lid.

7. The combline-cavity duplexer as recited in claim 1, wherein at least one probe in the set of probes includes an insulation layer.

8. The combline-cavity duplexer as recited in claim 1, wherein at least one probe in the set of probes corresponds to a center pin associated with the at least one common resonator.

9. The combline-cavity duplexer as recited in claim 8, wherein each center pin corresponds to a bare wire.

10. The combline-cavity duplexer as recited in claim 1, wherein a first probe of the set of probes is configured to be coupled with an external antenna, a second probe of the set of probes is configured to be coupled to a receive signal path, and a third probe of the set of probes is configured to be coupled to a transmit signal path, and wherein the receive filter is configured to filter signals for the receive signal path and the transmit filter is configured to filter signals for the transmit signal path.

11. The combline-cavity duplexer as recited in claim 1, wherein the combline-cavity duplexer is part of an antenna system.

12. The combline-cavity duplexer as recited in claim 11, wherein the antenna system is configured to be part of a cellular base station or enhanced node B (eNB) of a cellular network.

13. A duplexing apparatus comprising:

a plurality of resonators all provided within a single common cavity of a housing to form a combline cavity filter configured to operate as a filter network, each resonator being individually grounded; and a set of open-circuited probes, the probes configured to couple signals within the common cavity from the plurality of resonators to one or more external components through open-circuit probe coupling independent of a galvanic contact with the plurality of resonators, wherein the plurality of resonators are configured to provide a transmit filter and a receive filter in separate frequency bands for concurrent transmission and reception for frequency division duplexing operation, the plurality of resonators including one or more common resonators.

14. The duplexing apparatus as recited in claim 13, wherein at least one of the probes is configured to include a connector mounted on a lid associated with the duplexing apparatus.

15. The duplexing apparatus as recited in claim 14, wherein said at least one of the probes is configured to extrude through the lid associated with the duplexing apparatus.

16. The duplexing apparatus as recited in claim 13, wherein at least one of the probes has an insulation layer.

17. The duplexing apparatus as recited in claim 13, wherein at least one of the probes is configured to be coupled to an antenna feed.

18. The duplexing apparatus as recited in claim 13, wherein the plurality of resonators are configured as a duplexer.

19. An antenna system comprising:

an antenna feed element; and duplexer comprising:

a plurality of resonators including a set of transmit (TX) resonators and a set of receiver (RX) resonators, each of the plurality of resonators having a defined capacitance and individually grounded;

one or more common resonators, the one or more common resonators being common to the set of transmit resonators and the set of receive resonators;

wherein the plurality of resonators and the one or more common resonators are all provided within a single common cavity of the housing to form a combline cavity filter configured to operate as a filter network, wherein the filter network comprises a transmit filter and a receive filter to provide separate frequency bands for concurrent transmission and reception for frequency division duplexing operation, wherein the transmit fitter comprises the set of transmit resonators and the one or more common resonators, and wherein the receive filter comprises the set of receive resonators and the one or more common resonators; and a set of open-circuited probes, the probes to couple signals within the common cavity from the plurality of resonators to one or more external components including the antenna feed element through open-circuit probe coupling independent of a galvanic contact with the plurality of resonators.

20. The antenna system as recited in claim 19, wherein a first probe of the set of probes is configured to be coupled with the antenna feed element, a second probe of the set of probes is configured to be coupled to a receive signal path, and third probe of the set of probes is configured to be coupled to a transmit signal path, and wherein the receive filter is configured to filter signals for the receive signal path and the transmit filter is configured to filter signals for the transmit signal path.

21. The antenna system as recited in claim 20, wherein the antenna system is configured to be part of a cellular base station or enhanced node B (eNB) of a cellular network.

22. The antenna system as recited in claim 19, wherein the set of probes includes a connector mounted on a lid associated with the apparatus.

23. The antenna system as recited in claim 22, wherein the set of probes includes a probe extruding through the lid associated with the apparatus.

24. The antenna system as recited in claim 19, wherein the set of probes includes at least one probe having an insulation layer.

* * * * *